US006314886B1

(12) United States Patent
Kuhnle et al.

(10) Patent No.: US 6,314,886 B1
(45) Date of Patent: Nov. 13, 2001

(54) PROJECTILE TO BE FIRED FROM A WEAPON BARREL AND STABILIZED BY A GUIDE ASSEMBLY

(75) Inventors: Joachim Kuhnle, Baven; Thomas Heitmann, Unterlüss; Torsten Niemeyer, Celle; Norbert Arendt, Hamburg, all of (DE)

(73) Assignee: Rheinmetall W & M GmbH, Unterlüss (DE)

( * ) Notice: Subject to any disclaimer, the term of this patent is extended or adjusted under 35 U.S.C. 154(b) by 0 days.

(21) Appl. No.: 09/507,728

(22) Filed: Feb. 22, 2000

(30) Foreign Application Priority Data

Feb. 19, 1999 (DE) ..... 199 06 969

(51) Int. Cl.[7] ..... F42B 10/14; F42B 10/02

(52) U.S. Cl. ..... 102/3.28; 244/3.28; 244/3.2; 244/327; 244/3.24

(58) Field of Search ..... 244/3.28, 3.2, 244/3.24, 3.27

(56) References Cited

U.S. PATENT DOCUMENTS

| | | | | |
|---|---|---|---|---|
| H905 | * | 4/1991 | Rottenberg | 244/3.28 |
| 4,384,691 | | 5/1983 | Madderra . | |
| 4,440,360 | * | 4/1984 | Hallstrom | 244/3.28 |
| 4,534,294 | | 8/1985 | von Laar et al. . | |
| 4,624,424 | * | 11/1986 | Pinson | 244/3.21 |
| 4,641,802 | * | 2/1987 | Zalmon et al. | 244/3.28 |
| 4,869,441 | * | 9/1989 | Steuer | 244/3.28 |
| 5,029,773 | * | 7/1991 | Lecat | 244/3.28 |
| 5,452,864 | * | 9/1995 | Alford et al. | 244/3.23 |
| 5,668,347 | | 9/1997 | Milhail . | |
| 6,126,109 | * | 10/2000 | Barson et al. | 244/3.28 |

FOREIGN PATENT DOCUMENTS

| | | | | |
|---|---|---|---|---|
| 1 232 500 | | 7/1967 | (DE) . | |
| 85 13 566 | | 11/1985 | (DE) . | |
| 3408585-A1 | * | 12/1985 | (DE) | 244/3.28 |
| 0 186 903 | | 7/1986 | (EP) . | |
| 556302 | | 7/1923 | (FR) . | |
| 1377508-A1 | * | 9/1964 | (FR) | 244/3.24 |

* cited by examiner

*Primary Examiner*—Charles T. Jordan
*Assistant Examiner*—Lulit Semunegus
(74) *Attorney, Agent, or Firm*—Venable; Gabor J. Kelemen

(57) ABSTRACT

A projectile to be fired from a weapon barrel includes a projectile body and a plurality of stabilizing wings circumferentially distributed about a rearward portion of the projectile body. A pin pivotally attaches each stabilizing wing to the projectile body for pivotal motion about a pivot axis to assume a folded state and an outwardly pivoted, deployed state. In the folded state of the stabilizing wings the center of gravity of the respective stabilizing wings is at a greater radial distance from the longitudinal axis of the projectile body than the pivot axis. A gliding body is releasably mounted on each stabilizing wing. Each gliding body has a wing-shaped extension for contacting an inner surface of the barrel in the folded state of the stabilizing wings as the projectile travels in the barrel upon firing. In the deployed state of the stabilizing wings the wing-shaped extensions are exposed, during the flight of the projectile, to an air stream causing the gliding bodies to be stripped from the stabilizing wings.

6 Claims, 2 Drawing Sheets

PROJECTILE TO BE FIRED FROM A WEAPON BARREL AND STABILIZED BY A GUIDE ASSEMBLY

CROSS REFERENCE TO RELATED APPLICATION

This application claims the priority of German Application Ser. No. 199 06 969.7 filed Feb. 19, 1999, which is incorporated herein by reference.

BACKGROUND OF THE INVENTION

This invention relates to a projectile designed to be fired from a weapon barrel and stabilized by a guide assembly.

Projectiles of the above type have been known for a long time. The guide assembly includes a plurality of stabilizing wings which are mounted on the rearward portion of the projectile in a circumferentially uniformly distributed array and which are deployed (pivoted outwardly) as the projectile leaves the weapon barrel. In the weapon barrel the wings lie against the projectile body and as the projectile leaves the weapon barrel the wings pivot rearwardly into their deployed (open) position.

In conventional projectiles where in the folded state of the guide assembly the pivot axis of the respective wing is located radially outwardly relative to the center or gravity of the wing, the wings lie against the projectile while accelerated in the barrel. Disadvantageously, however, relatively large forces are needed for opening the guide assembly after the projectile has left the weapon barrel. This circumstance requires, for example, expensive and heavy spring systems which are necessarily accelerated with the projectile as dead weight.

In guide assemblies in which the respective center of gravity of the wings is, in the folded state of the guide assembly, located radially outwardly relative to the rotary axis of the respective wing, due to acceleration in the weapon barrel, the wings are frequently pressed against the inner barrel wall and thus may cause damage thereto. Thus, the wings may "hook" into the delicate inner chromium layer of the weapon barrel.

German Patent No. 1,232,500 discloses a projectile having a fixed guide assembly. On the upper wing edges narrow plastic gliding bodies are mounted for guidance in the weapon barrel. To ensure that the gliding bodies are cast off after the projectile leaves the weapon barrel, they have a relatively complex construction: Between the gliding body and the respective stabilizing wing a hollow space is formed which is externally accessible by connecting channels. A significant quantity of propellant gases penetrates into the hollow chamber during the firing process and causes a separation of the gliding body from the stabilizing wing after the projectile leaves the weapon barrel.

SUMMARY OF THE INVENTION

It is an object of the invention to provide an improved projectile of the above-outlined type wherein the stabilizing wings and the inner face of the weapon barrel do not damage one another as the projectile passes through the weapon barrel and wherein the stabilizing wings open in a simple manner as soon as the projectile has cleared the weapon barrel.

This object and others to become apparent as the specification progresses, are accomplished by the invention, according to which, briefly stated, the projectile to be fired from a weapon barrel includes a projectile body and a plurality of stabilizing wings circumferentially distributed about a rearward portion of the projectile body. A pin pivotally attaches each stabilizing wing to the projectile body for pivotal motion about a pivot axis to assume a folded state and an outwardly pivoted, deployed state. In the folded state of the stabilizing wings the center of gravity of the respective stabilizing wings is at a greater radial distance from the longitudinal axis of the projectile body than the pivot axis. A gliding body is releasably mounted on each stabilizing wing. Each gliding body has a wing-shaped extension for contacting an inner surface of the barrel in the folded state of the stabilizing wings as the projectile travels in the barrel upon firing. In the deployed state of the stabilizing wings the wing-shaped extensions are exposed, during the flight of the projectile, to an air stream causing the gliding bodies to be stripped from the stabilizing wings.

According to the basic principle of the invention, in a projectile having stabilizing wings, the center or gravity of the wings in the folded state of the guide assembly is located radially outwardly relative to the pivot axes of the wings (that is, the radial distance of the center of gravity from the projectile axis is greater than that of the pivot axis) and the stabilizing wings are supported on the inner face of the weapon barrel by gliding bodies. To ensure a simple removal of the gliding bodies after the projectile has left the weapon barrel, the gliding bodies have, as viewed in the circumferential direction, arcuate wing-like extensions conforming to the inner face of the weapon barrel so that the gliding bodies, after the stabilizing wings open, are stripped by the forces of the air flow to which the wing-like extensions are exposed.

Advantageously, the preferably plastic gliding bodies are disposed in recesses of the upper edge of the stabilizing wings.

DESCRIPTION OF THE PREFERRED EMBODIMENT

Figure 1:
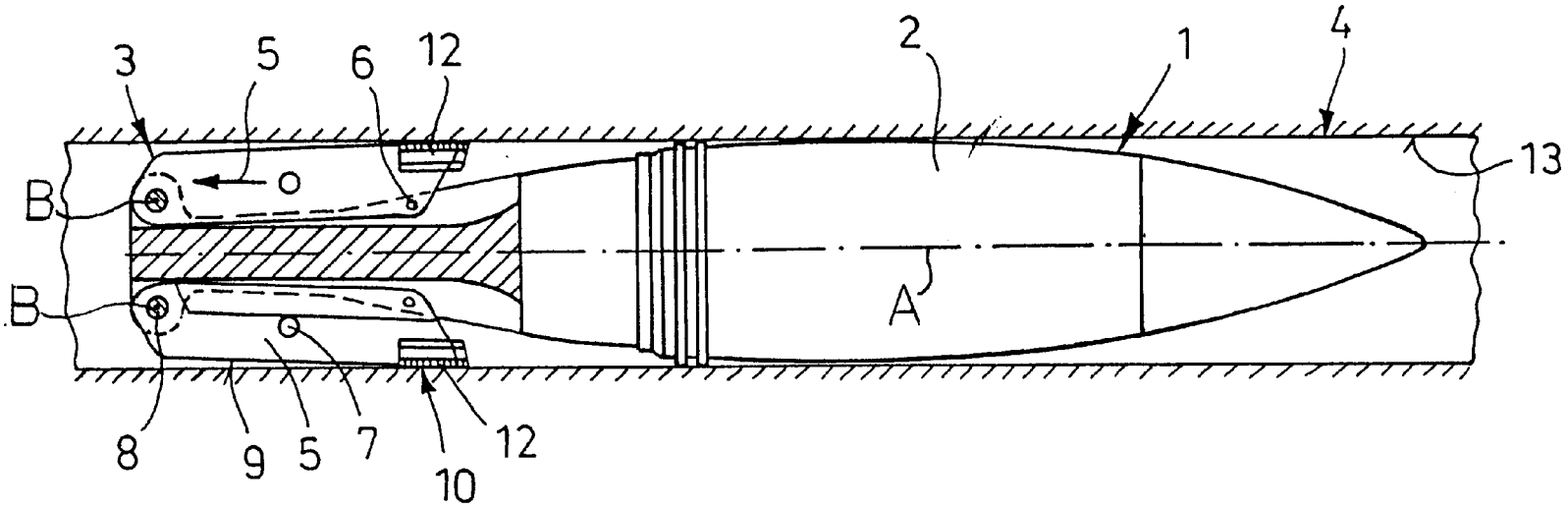
FIG. 1 is partially sectional side elevational view of a projectile according to the invention, having a guide assembly shown in the folded state and gliding bodies mounted on the stabilizing wings.

FIG. 1 shows a projectile 1 having a projectile body 2 and a collapsible (foldable) guide assembly 3 mounted on the rear portion of the projectile body. The projectile 1, having an axis A, is positioned in a weapon barrel 4.

The guide assembly 3 has a plurality of stabilizing wings 5 which are uniformly distributed about the circumference of the projectile 1 and which, when the projectile is within the weapon barrel, closely lie against the projectile body 2 and are held in that position by securing pins 6. The stabilizing wings 5 are attached to the projectile body 2 by pivot pins 8 for a swinging motion about respective rotary axes B. In the folded state of the wings 5 the center of gravity 7 of the respective stabilizing wing 5 has a greater radial distance from the projectile axis A than the respective rotary axis B.

Figure 2:
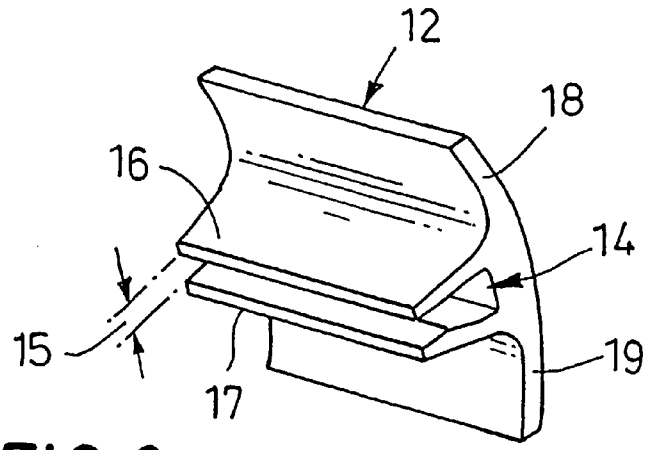
FIG. 2 is a perspective view of a stabilizing wing shown in FIG. 1.
Figure 3:
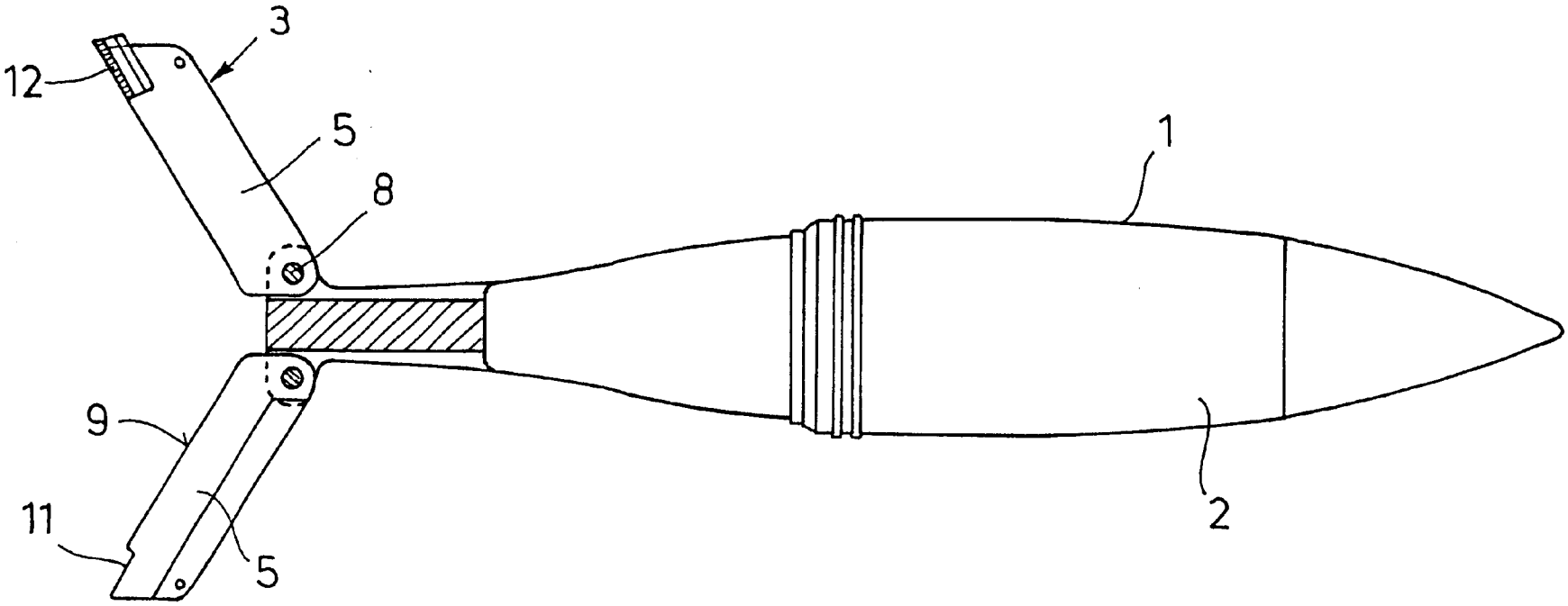
FIG. 3 is a side elevational view of the projectile illustrated in FIG. 1 shown with a deployed guide assembly, after the projectile has left the weapon barrel.

Turning to FIGS. 2 and 3, the upper edges 9 of the stabilizing wings 5 are provided in their frontal region 10 with recesses 11 which receive releasable plastic gliding bodies 12. Upon firing the projectile the stabilizing wings 5 are forced radially outwardly and the securing pins 6 are sheared off so that the stabilizing wings are supported by the inner face 13 of the weapon barrel 4 with the intermediary of the gliding bodies 12.

Each gliding body 12 has on its side oriented towards the respective stabilizing wing 5 a cross-sectionally U-shaped socket 14 for receiving a portion of the stabilizing wing 5. The distance 15 between the two legs 16 and 17 of the socket 14 ensures that the socket 14 and the respective stabilizing wing 5 is seated in the socket 15 with a press fit.

The gliding bodies 12 have, as viewed in the circumferential direction of the projectile 1, wing-like arcuate extensions 18, 19 adapted to the curvature of the inner face of the weapon barrel 4. After the stabilizing wings 5 deploy as the projectile 1 clears the weapon barrel 4, the extensions 18, 19 are caught in the air stream whose force thus strips the gliding bodies 12 off the wings 5.

It will be understood that the above description of the present invention is susceptible to various modifications, changes and adaptations, and the same are intended to be comprehended within the meaning and range of equivalents of the appended claims.

What is claimed is:

1. A projectile to be fired from a weapon barrel, comprising (a) a projectile body having a rearward portion and a longitudinal axis;

(b) a plurality of stabilizing wings circumferentially distributed about said rearward portion; each stabilizing wing having a center of gravity;

(c) a pin pivotally mounting each said stabilizing wing on said projectile body for pivotal motion about a pivot axis to assume a folded state and an outwardly pivoted, deployed state; in the folded state of said stabilizing wings said center of gravity of respective said stabilizing wings being at a greater radial distance from said longitudinal axis than said pivot axis; and (d) a gliding body releasably mounted on each said stabilizing wing; each said gliding body having a wing-shaped extension for contacting an inner surface of the barrel in the folded state of the stabilizing wings as the projectile travels in the barrel upon firing; in the deployed state of said stabilizing wings said wing-shaped extensions being exposed, during flight of the projectile, to an air stream causing said gliding bodies to be stripped from said stabilizing wings.

2. The projectile as defined in claim 1, wherein each said stabilizing wing has an outer edge provided with a recess receiving said gliding body.

3. The projectile as defined in claim 1, wherein said gliding bodies are plastic.

4. The projectile as defined in claim 1, wherein each said gliding body has a mounting portion including two parallel-extending legs together having a generally U-shaped cross section; each said stabilizing wing having an edge portion received with a press fit between said legs.

5. The projectile as defined in claim 1, further comprising a retaining pin for holding a respective said stabilizing wing in the folded state and for being sheared off upon movement of the stabilizing wing from said folded state.

6. The projectile as defined in claim 1, in combination with the weapon barrel; said weapon barrel having an inner curved surface; said wing-shaped extension having a curved outer surface conforming to said inner curved surface of said weapon barrel.

* * * * *